US010094084B2

(12) United States Patent
Weiss

(10) Patent No.: US 10,094,084 B2
(45) Date of Patent: Oct. 9, 2018

(54) TRACK CLEARER HAVING AERODYNAMIC GUIDE PLATES

(71) Applicant: SIEMENS AKTIENGESELLSCHAFT, Munich (DE)

(72) Inventor: Thomas Weiss, Munich (DE)

(73) Assignee: Siemens Aktiengesellschaft, Munich (DE)

( * ) Notice: Subject to any disclaimer, the term of this patent is extended or adjusted under 35 U.S.C. 154(b) by 207 days.

(21) Appl. No.: 15/025,311

(22) PCT Filed: Sep. 27, 2013

(86) PCT No.: PCT/EP2013/070228

§ 371 (c)(1),
(2) Date: Mar. 28, 2016

(87) PCT Pub. No.: WO2015/043661

PCT Pub. Date: Apr. 2, 2015

(65) Prior Publication Data

US 2016/0222615 A1 Aug. 4, 2016

(51) Int. Cl.
*E01H 8/04* (2006.01)
*E01H 5/06* (2006.01)

(52) U.S. Cl.
CPC ..... *E01H 8/04* (2013.01); *E01H 5/066* (2013.01)

(58) Field of Classification Search
CPC .... E01H 5/00; E01H 8/00; E01H 8/02; E01H 8/04; E01H 8/10; E01H 8/12
See application file for complete search history.

(56) References Cited

U.S. PATENT DOCUMENTS

| | | | | |
|---|---|---|---|---|
| 193,384 A | 7/1877 | Royal | | |
| 413,305 A | 10/1889 | Phillips | | |
| 1,518,685 A * | 12/1924 | Berczik | E01H 8/04 | 37/217 |
| 2,237,891 A * | 4/1941 | Shipley | E01H 8/04 | 37/217 |
| 2,374,312 A * | 4/1945 | Tagkett | E01H 8/00 | 172/26 |
| 3,468,042 A * | 9/1969 | Coy | E01B 27/025 | 15/54 |
| 4,274,212 A * | 6/1981 | Kurkela | E01H 8/04 | 37/105 |

FOREIGN PATENT DOCUMENTS

| | | |
|---|---|---|
| DE | 2160492 A1 | 6/1973 |
| EP | 2003250 A2 | 12/2008 |
| WO | 2010124925 A1 | 4/2010 |

* cited by examiner

*Primary Examiner* — Robert J McCarry, Jr.
(74) *Attorney, Agent, or Firm* — Laurence Greenberg; Werner Stemer; Ralph Locher

(57) ABSTRACT

A device for removing obstacles from a travel path of a vehicle includes clearing blades being mutually aligned in the form of a wedge and each having a wedge tip end facing the other clearing blade and a free end facing away from the wedge tip end. A fastening device or fastener fastens the device to the vehicle and a device for reducing a pileup generated by the clearing blades reduces pressure fluctuations at the vehicle tip without the need for providing the clearing blades with passages, apertures, or the like. The device for reducing the pileup has at least one vertical guide plate disposed in the vicinity or region of the free end of a clearing blade so that an air stream generated by the clearing blade flows past the vertical guide plate.

6 Claims, 3 Drawing Sheets

TRACK CLEARER HAVING AERODYNAMIC GUIDE PLATES

BACKGROUND OF THE INVENTION

Field of the Invention

The invention relates to a device for removing obstacles from a travel path of a vehicle, comprising clearing blades aligned in the form of a wedge with respect to each other, each having a wedge tip end facing the other clearing blade and a free end facing away from the wedge tip end, fastening means for fastening the device to the vehicle, and means for reducing a pileup generated by the clearing blades.

The invention also relates to a rail vehicle having a chassis, a vehicle body which is supported on the chassis and has side walls and a device for removing obstacles from a travel path, which is fixedly connected to the rail vehicle by way of two clearing blades aligned in the form of a wedge with respect to each other, each having a wedge tip end facing the other clearing blade and a free end facing away from the wedge tip end.

Such a device and such a rail vehicle are already known from WO 2010/124925 A1. The locomotive shown there has a snow clearer with two clearing blades aligned in the form of a wedge, said clearing blades being installed at the front of the locomotive. A pressure fluctuation is generated at the vehicle tip particularly when travelling at high speed, this is generally known as a pileup. In order to reduce this pressure fluctuation, the clearing blades of the afore-cited snow clearer are not embodied over the entire surface, but are instead provided with passages, in which guide vanes are arranged, with the help of which the air flowing through the passages is deflected downwards.

A further travel path clearer is known from EP 2 003 250 A2, which likewise has clearing blades arranged in the form of a wedge. The clearing blades have an end facing the shared wedge tip and a free end facing away herefrom, at which the respective clearing blade is extended by means of scraper webs. The scraper webs delimit orifices in order to reduce the air resistance.

BRIEF SUMMARY OF THE INVENTION

The object of the invention is to provide a device and a rail vehicle of the type cited in the introduction, with which the pressure fluctuations at the vehicle tip can be reduced without having to provide the clearing blades with passages, apertures, or the like.

The invention achieves this object on the basis of the device cited in the introduction in that the means for reducing the pileup have at least one vertical guide plate, which is arranged in the region of the free end of a clearing blade so that an air stream generated by the clearing blade flows past the vertical guide plate.

The invention achieves this object on the basis of the vehicle cited in the introduction by means of at least one vertical guide plate, which is arranged in the region of the free end of the clearing blade and has a surface section which extends at right angles to the travel path.

In accordance with the invention means are provided to reduce the pileup, said means having a vertical guide plate. The vertical guide plate is arranged in the vicinity of the free end of a clearing blade, so that the air displaced laterally by the clearing blades flows past the vertical guide plate. Two vertical guide plates are provided for instance with two clearing blades. The vertical guide plates are embodied as wing-type smoke deflector devices, so that the air masses displaced laterally by the wedge-shaped clearing blades generate a smaller aerodynamic separation region compared with the device without guide plates. The maximum pressure fluctuations of the pileup are reduced in this way. The vertical guide plate is advantageously arranged laterally, in other words in the transverse direction, offset from the free end of the respectively assigned clearing blade. It thus ensures that the air stream generated by the respective clearing blade interacts with the vertical guide plate.

The vertical guide plate has at least one section with a surface which is aligned vertically or in other words at right angles to a horizontal plane. The horizontal plane is the surface of the travel path for instance, if this is likewise flat and free of hills or suchlike. The vertical surface of the vertical guide plate generates a smaller aerodynamic separation region. The manner in which the vertical guide plate is arranged offset in the transverse direction or in other words laterally to the free end of the respective clearing blade is basically arbitrary within the scope of the invention.

The term "aligned in the form of a wedge with respect to each other" is to be understood within the scope of the invention to mean that the two clearing blades form a wedge with a wedge tip, wherein the clearing blades either make contact with the wedge tip or the wedge tip is embodied as a point of intersection of its intended extensions. In other words, the clearing blades do not need to mutually contact one another, but can instead be arranged at a distance from one another at their ends which face one another. The clearing blades generally however touch one another with their wedge tip end and physically form a wedge tip. With respect to the wedge tip, the clearing blades span an acute angle. The clearing blades are expediently concavely arched here, as is typical in practice.

Each clearing blade is advantageously embodied over the entire surface and is free of inner orifices. Provision is thus made within the scope of the invention for a V-shaped arrangement of clearing blades, wherein if need be the clearing blades have recesses on their outer upper and lower edges, but are otherwise free of openings. The provision of inner orifices, as proposed within the prior art, has therefore become superfluous within the scope of the invention. This has an advantageous effect on the clearing behavior of the inventive device. Within the scope of the invention, the clearing blades can extend entirely across the travel path in the transverse direction so that these generate a planar air resistance. Limiting or reducing the pileup takes place solely by means of the vertical guide plate or the vertical guide plates.

According to a preferred further development of the invention, each vertical guide plate has a surface section, which is aligned in parallel with a plane, in which the wedge tip and the bisecting line of the angle are disposed, which in a top view of clearing blades is spanned in respect of the wedge tip. The said plane thus extends from the wedge tip symmetrically through the wedge arrangement of the clearing blades, wherein it extends in a vertical direction in respect of a horizontal travel path. The vertical guide plate advantageously comprises a surface section, which is arranged in parallel to this plane. In the assembled state, the said surface section would thus be aligned in parallel to the side wall of the rail vehicle.

Moreover, it is expedient if the means for reducing the pileup have at least one horizontal guide plate, with which a vertical guide plate is fastened to the respective clearing blade. The horizontal guide plate or guide plates serve however substantially to fasten the vertical guide plate to the respective clearing blade. Within the scope of the invention, the aerodynamic effect is almost exclusively provided by the vertical guide plate or guide plates.

A number of vertical guide plates are advantageously provided. Within the scope of the invention, each clearing blade can be equipped with a vertical guide plate. Moreover, it is however also possible for two, three or even more vertical guide plates to be provided on a clearing blade.

The vertical guide plate advantageously has an inflow side facing the wedge tip, which is arched toward the respective clearing blade. The air resistance is reduced even further in this way.

Moreover, it is also possible for each vertical guide plate to have an inflow side facing the wedge tip, which is aligned obliquely in respect of a horizontal plane, in other words upwards or downwards. This embodiment or configuration of the vertical guide plate can also produce aerodynamic advantages.

BRIEF DESCRIPTION OF THE SEVERAL VIEWS OF THE DRAWING

Further expedient embodiments and advantages of the invention form the subject matter of the description of exemplary embodiments of the invention below with reference to the figures in the drawing, wherein the same reference characters relate to components which act the same and wherein FIG. 1 has an exemplary embodiment of the inventive device and the inventive rail vehicle in a perspective representation, FIG. 2 has a further exemplary embodiment of the inventive device and the inventive rail vehicle, FIG. 3 has a further exemplary embodiment of the inventive device and the inventive rail vehicle, FIG. 4 has a further exemplary embodiment of the inventive rail vehicle and the inventive device and FIG. 5 has a further exemplary embodiment of the inventive rail vehicle and the inventive device.

DESCRIPTION OF THE INVENTION

Figure 1:
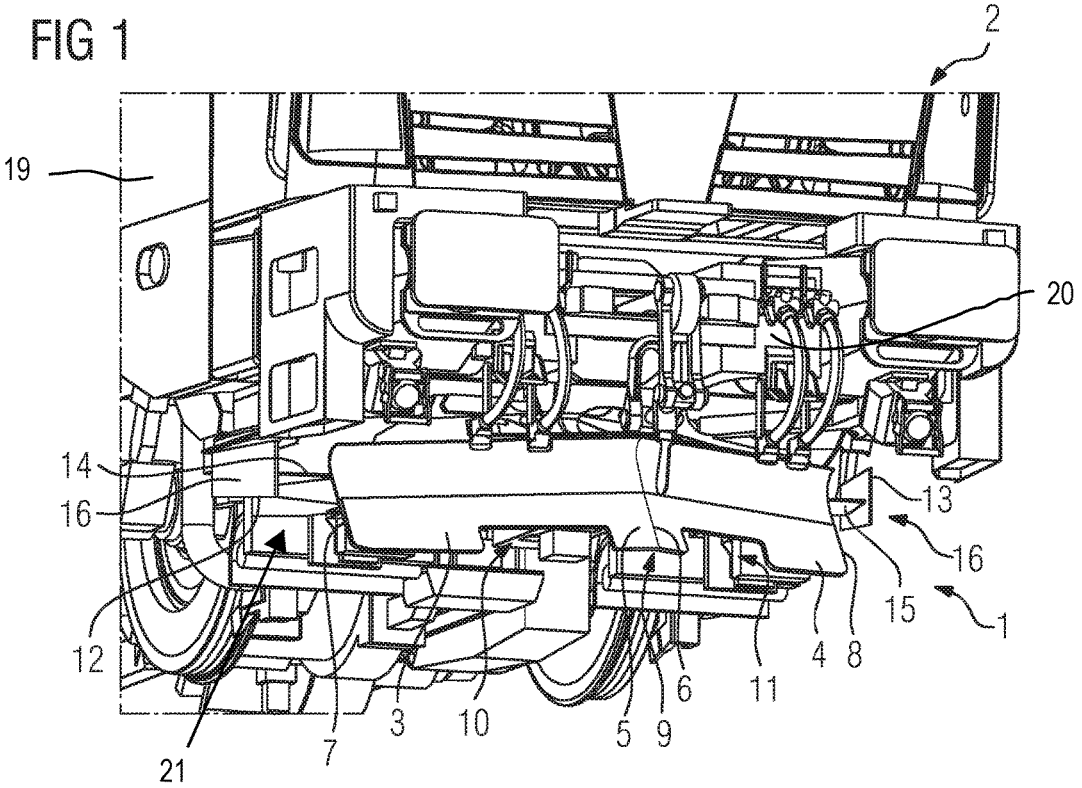

FIG. 1 shows a first exemplary embodiment of the inventive device 1, which is provided for removing obstacles from a travel path of a locomotive 2 as a rail vehicle. To this end, the device 1 is fastened to the locomotive 2 by a mount (not shown in more detail). The device 1 has two clearing blades 3 and 4 which are aligned in the form of a wedge with respect to each other, which each have a wedge tip end 5 and 6 which face one another. Moreover, each clearing blade 3, 4 has a free end 7 or 8, which faces away from the respective wedge tip end 5, 6.

The clearing blades 3 and 4 extend both in the direction of travel, which is referred to here below as longitudinal direction, and also in the transverse direction, wherein the device 1, which is connected to the locomotive 2 by a fastening device 21, extends in the transverse direction almost across the entire width of the locomotive 2 and thus across almost the entire width of the guideway. A vertical direction, in which in practice the height is plotted, extends at right angles to this longitudinal and transverse direction which runs in parallel to the travel path, which is also referred to here as horizontal plane. In the region of the free ends 7 and 8 of each clearing blade 3 or 4, a vertical guide plate 12 or 13 is arranged in each case as a means for reducing the pileup. Each vertical guide plate 12 or 13 is connected to the respectively assigned clearing blade 3 or 4 by way of a horizontal guide plate 14 or 15. Each vertical guide plate 12, 13 here has a section with a surface 16, which extends in the vertical direction, in other words at right angles upwards in respect of the horizontal. Here the intended longitudinal axes of the surfaces 16 and 17 can have a point of intersection with one another like the clearing blades, as indicated in FIG. 1. Conversely, the longitudinal axes of the surfaces 16 can also be aligned in parallel with the longitudinal direction so that the intended axes do not have a shared point of intersection. The surface 16 of the said section of the vertical guide plate 12, 13 is then aligned in parallel to the side wall 19 of the body of the locomotive 2 which is supported on the chassis 20.

Figure 2:
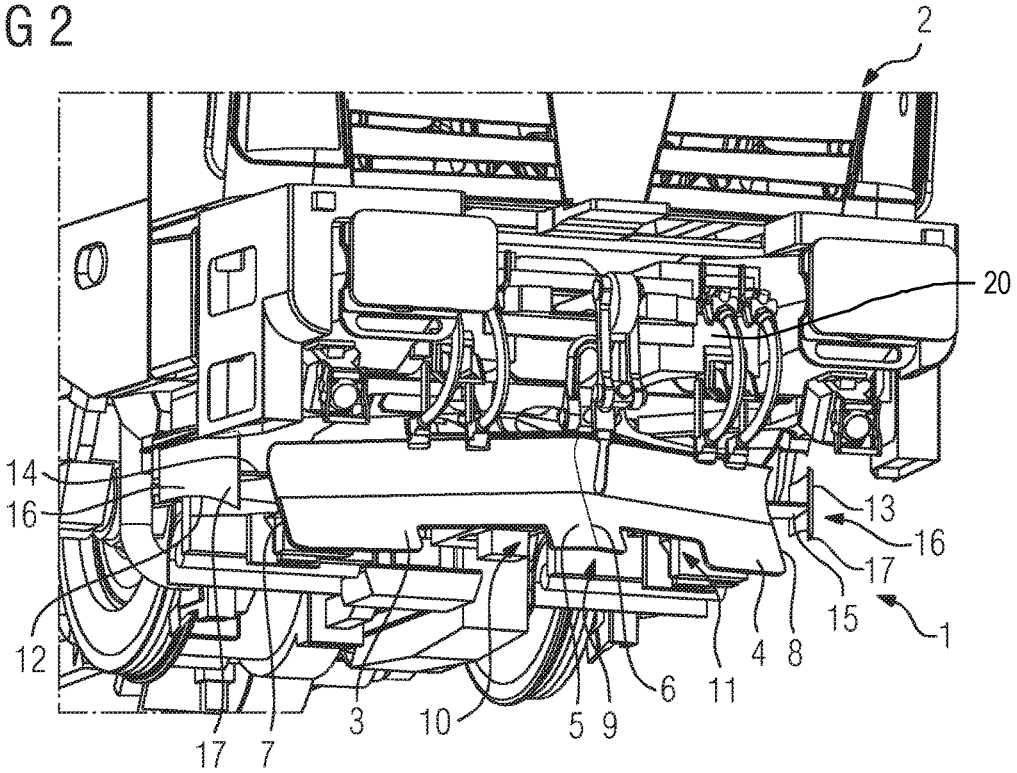

FIG. 2 differs from the exemplary embodiment shown in FIG. 1 in that the vertical guide plates 12 and 13 have an inflow side 17 at their end pointing in the direction of travel, which therefore faces the wedge tip 9, which, in the transverse direction, is therefore curved toward the other clearing blade in each case. The aerodynamics of the device 1 or of the rail vehicle 2 are improved still further in this way. Moreover, design aspects can be taken into account.

Figure 3:
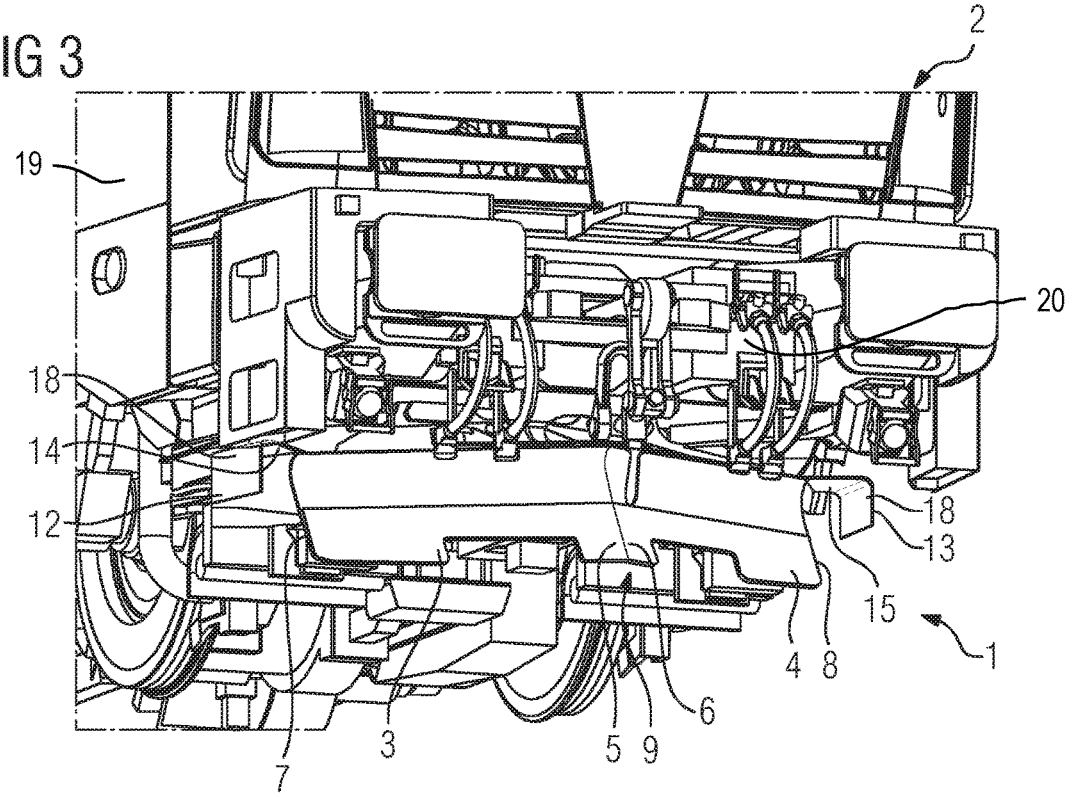

FIG. 3 shows a further exemplary embodiment of the inventive device 1, which differs from the exemplary embodiment shown in FIG. 1 in that the horizontal guide plates 14 and 15 are not connected centrally with the vertical guide plate 12 or 13, for instance welded, but are instead molded to the respective vertical guide plate. Here the respective horizontal guide plate 14, 15 serves to connect the vertical guide plate 12, 13 to the respective clearing blade 3, 4, wherein a curvature 18 results on the top side of the respective vertical guide plate 12 or 13.

Figure 4:
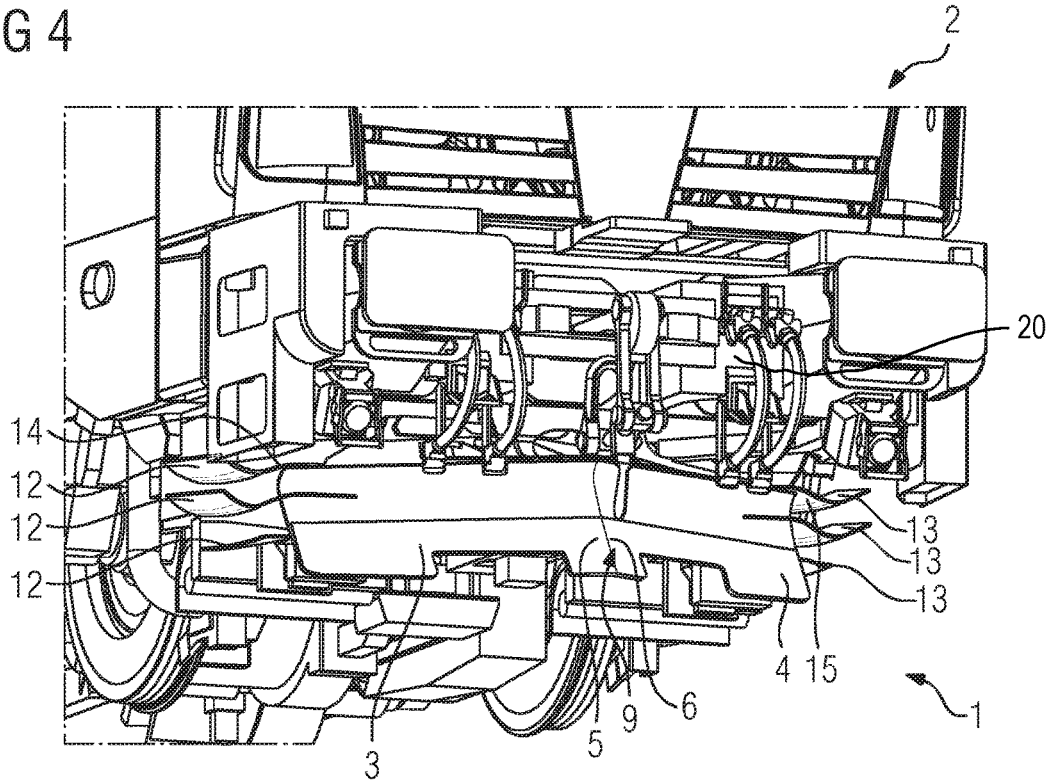

FIG. 4 shows a further exemplary embodiment of the inventive device 1, wherein a number of vertical guide plates 12 or 13 are arranged on a clearing blade 3 or 4 in each case. Here the respective vertical guide plate 12, 13 is likewise embodied in one piece with the respective horizontal guide plate 14, 15.

Figure 5:
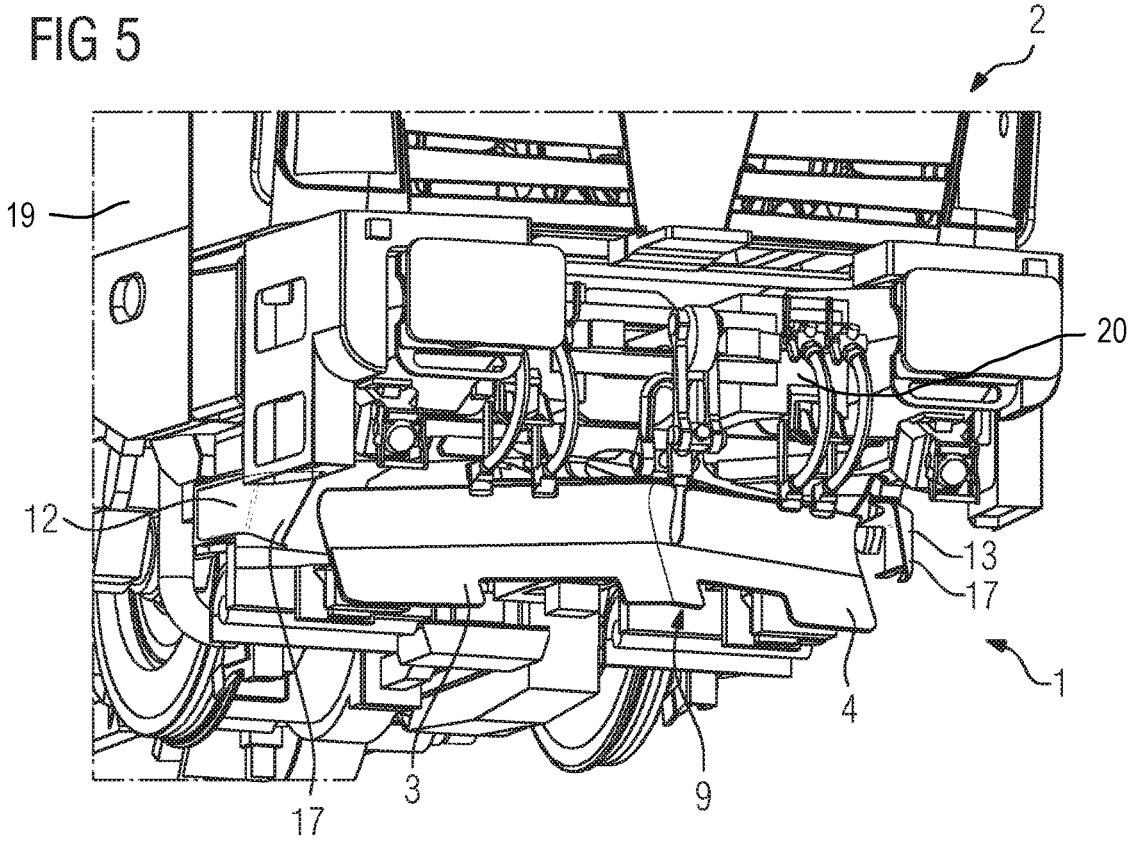

FIG. 5 shows a further exemplary embodiment of the inventive device 7, which differs from the exemplary embodiment shown in FIG. 1 again by the embodiment of the means for reducing the pileup, in other words by the respective vertical guide plate 12 or 13. The respective guide plate 12 or 13 thus here comprises an inflow side 17, which is curved both toward the respective clearing blade 3 or 4 and also in respect of the horizontal, which is defined for instance by the lower edges of the clearing blades 3, 4, in other words is sloped upwards or downwards, so that the displaced air is deflected upwards while the locomotive is traveling.

The invention claimed is:

1. A rail vehicle, comprising:

a chassis;

a vehicle body supported on said chassis and having side walls;

a device for removing obstacles from a travel path, said device including two clearing blades being mutually aligned in a wedge shape, each of said clearing blades having a respective wedge tip end facing the other clearing blade and a respective free end facing away from said wedge tip end;

a fastener fixedly connecting said device to the rail vehicle;

a device for reducing a pileup generated by said clearing blades, said device for reducing the pileup including:

at least one vertical guide plate disposed in a region of said free end of at least one of said clearing blades and causing an air stream generated by said at least one clearing blade to flow past said at least one vertical guide plate, and at least one horizontal guide plate each fastening said at least one vertical guide plate to a respective one of said clearing blades.

2. The rail vehicle according to claim 1, wherein each of said clearing blades has an uninterrupted surface and is free of inner orifices.

3. The rail vehicle according to claim 1, wherein:

said wedge tip ends form a wedge tip;

said wedge shape forms an angle defining a bisecting line, said angle, in a top view, is spanned in front of said clearing blades relative to said wedge tip;

said wedge tip and said bisecting line are disposed in a plane; and each of said vertical guide plates has a surface section aligned parallel to said plane.

4. The rail vehicle according to claim 1, wherein said at least one vertical guide plate includes a plurality of vertical guide plates.

5. The rail vehicle according to claim 4, wherein said wedge tip ends form a wedge tip, and each of said vertical guide plates has an inflow side facing said wedge tip and being sloped downwards or upwards in a direction of travel of the vehicle.

6. The rail vehicle according to claim 1, wherein said wedge tip ends form a wedge tip, and said at least one vertical guide plate has an inflow side facing said wedge tip and being arched toward a respective one of said clearing blades.

* * * * *